United States Patent [19]

Mumford et al.

[11] Patent Number: 4,887,432

[45] Date of Patent: Dec. 19, 1989

[54] GAS TURBINE COMBUSTION CHAMBER WITH AIR SCOOPS

[75] Inventors: Stephen E. Mumford, Longwood; Jan P. Smed, Winter Springs, both of Fla.

[73] Assignee: Westinghouse Electric Corp., Pittsburgh, Pa.

[21] Appl. No.: 255,577

[22] Filed: Oct. 7, 1988

[51] Int. Cl.[4] ..... F23R 3/08

[52] U.S. Cl. ..... 60/759; 60/760

[58] Field of Search ..... 60/759, 760, 755, 757, 60/752, 39.31; 431/351, 352

[56] References Cited

U.S. PATENT DOCUMENTS

| | | | |
|---|---|---|---|
| 2,510,645 | 6/1950 | McMahan | 60/759 |
| 3,184,918 | 5/1965 | Mulcahey | 60/759 |
| 3,594,109 | 7/1971 | Penny | 60/39.32 |
| 3,656,297 | 4/1972 | Monk | 60/755 |
| 3,702,058 | 11/1972 | DeCorso et al. . | |
| 3,899,882 | 8/1975 | Parker | 60/757 |
| 4,073,137 | 2/1978 | Roberts | 60/752 |
| 4,104,872 | 8/1978 | Caruel et al. . | |
| 4,132,066 | 1/1979 | Austin, Jr. et al. | 60/752 |
| 4,315,405 | 2/1982 | Pidcock et al. | 60/752 |
| 4,567,730 | 2/1986 | Scott . | |
| 4,607,487 | 8/1986 | Tilston . | |
| 4,622,821 | 11/1986 | Madden | 60/757 |
| 4,695,247 | 9/1987 | Enzaki et al. | 431/352 |
| 4,700,544 | 10/1987 | Fucci | 60/759 |
| 4,720,979 | 1/1988 | Mink | 60/752 |
| 4,773,227 | 9/1988 | Chabis | 60/757 |
| 4,805,397 | 2/1989 | Barbier et al. | 60/759 |

*Primary Examiner*—Louis J. Casaregola
*Assistant Examiner*—Timothy S. Thorpe
*Attorney, Agent, or Firm*—K. Bach

[57] ABSTRACT

A gas turbine combustion chamber with an inlet and outlet has apertures in the combustion chamber wall and air scoops provided in the apertures, the air scoops having an outer tubular member and coaxially spaced inner tubular member. The spaced tubular members have inner cylindrical portions and outwardly extending flanges, with spacers disposed between and secured to the flanges with cooling air passing therebetween and through the annular air flow passage into the combustion chamber. Preferably, a radially outwardly extending arcuate section on the inner tubular member has a radius at least about one-third of the inner diameter of the inner cylindrical portion thereof.

7 Claims, 2 Drawing Sheets

GAS TURBINE COMBUSTION CHAMBER WITH AIR SCOOPS

FIELD OF THE INVENTION

This invention relates to a gas turbine engine combustor and particularly to cooling of air scoops used to introduce air into the combustion chamber.

BACKGROUND OF THE INVENTION

In order to achieve increased efficiency in gas turbines, higher temperatures are desired in the combustion chamber of the turbine. With the use of such higher temperatures, the walls of the combustion chamber are subjected to thermal stresses and strain. Also, because of economic reasons, it is often desirable to burn heavy residual fuels, which are high in contaminants, rather than pure fuels, which residual fuels add substantially more heat to the combustor chamber walls, such that combustor life and reliability are reduced.

While the use of ceramic combustion chamber walls has been proposed to solve these problems, most combustion chamber walls are still formed from metallic components.

Another solution to solving these problems is to introduce more cooling air to the combustor walls. Such increased air addition, however, has an adverse affect on the temperature distribution pattern of the gases when they are introduced to the turbine blades since there is a large temperature differential between the blade ends where the cooler air flows, and the blade center, which causes serious thermal stress and strain on the blades.

A gas turbine, with improved cooling for the walls of the combustor basket is described in U.S. Pat. No. 3,899,882, which issued to Stephen R. Parker on Aug. 19, 1975 and is assigned to the assignee of the present invention, the contents of said patent being incorporated by reference herein. The combustor described therein has a plurality of combustion air orifices or apertures that are disposed in an annular array about the wall of the combustor. Apertures, known as air scoops, are comprised of a tubular portion, a generally annular flange portion, and an intermediate spacer member that is disposed between the wall of the combustor and the annular flange portion of the air scoop. An arcuate gap is provided on the downstream side of the air scoop that permits the flow of air therethrough and cooling of the combustion basket walls. A tubular portion of the air scoop, which extends radially inwardly into the combustion chamber, forces some of the air into the inner portion of the combustor for combustion of the fuel and mixing of the combustion products.

While the features of the combustion chamber of U.S. Pat. No. 3,899,882 do provide cooling of combustor chamber walls, and introduction of air used to burn fuel, in the combustor basket, a problem is posed by the burning away of the extended tubular portion of the scoop which can lead to costly repairs and customer dissatisfaction. The tubular portion of the scoop burns because of the excessive temperature in an oxidizing atmosphere existing in the combustion chamber. The air that flows through the tubular section of the scoop is unable to keep the metal cool because of local separation. The sharp radius that exists at the connection between the annular flange and the tubular portion of the scoop encourages such separation.

It is an object of the present invention to provide a gas turbine combustion chamber with air scoops through the wall of the chamber which air scoops are provided with cooling and which prevent local separation within the scoop to improve flow control of the air into the combustion chamber.

SUMMARY OF THE INVENTION

With this object in view the present invention resides in a gas turbine combustion chamber having means for admission of fuel to the upstream end and discharge of hot gases from the downstream end, the wall of the combustion chamber having apertures therethrough with air scoops of particular construction provided through the apertures to direct air into the combustion chamber.

The air scoops have an outer tubular member with an inner cylindrical portion and first outer flange, the flange secured to the outer surface of the combustion chamber, and an inner tubular member with an inner cylindrical portion, of an outer diameter less than that of the cylindrical portion of the outer tubular member, coaxially positioned therein. An annular air flow passage is thus provided between the tubular members. The inner tubular member has a second outer flange which overlies the first outer flange of the inner tubular member. At least one spacer member is provided between and secured to the two flanges to allow cooling air flow therebetween and through the annular air flow passage into the combustion chamber.

Improved air flow through the inner tubular member is achieved by providing an inner cylindrical portion of the inner tubular member with a predetermined inner diameter, and a radially outwardly extending arcuate section between the inner cylindrical portion and the second flange, the radially outwardly extending arcuate section having a radius which is at least about one-third of the predetermined inner diameter of the inner tubular member.

BRIEF DESCRIPTION OF THE DRAWINGS

The invention will become more readily apparent from the following description of a preferred embodiment thereof, shown by way of example only, in the accompanying drawings, wherein.

DETAILED DESCRIPTION

Figure 1:
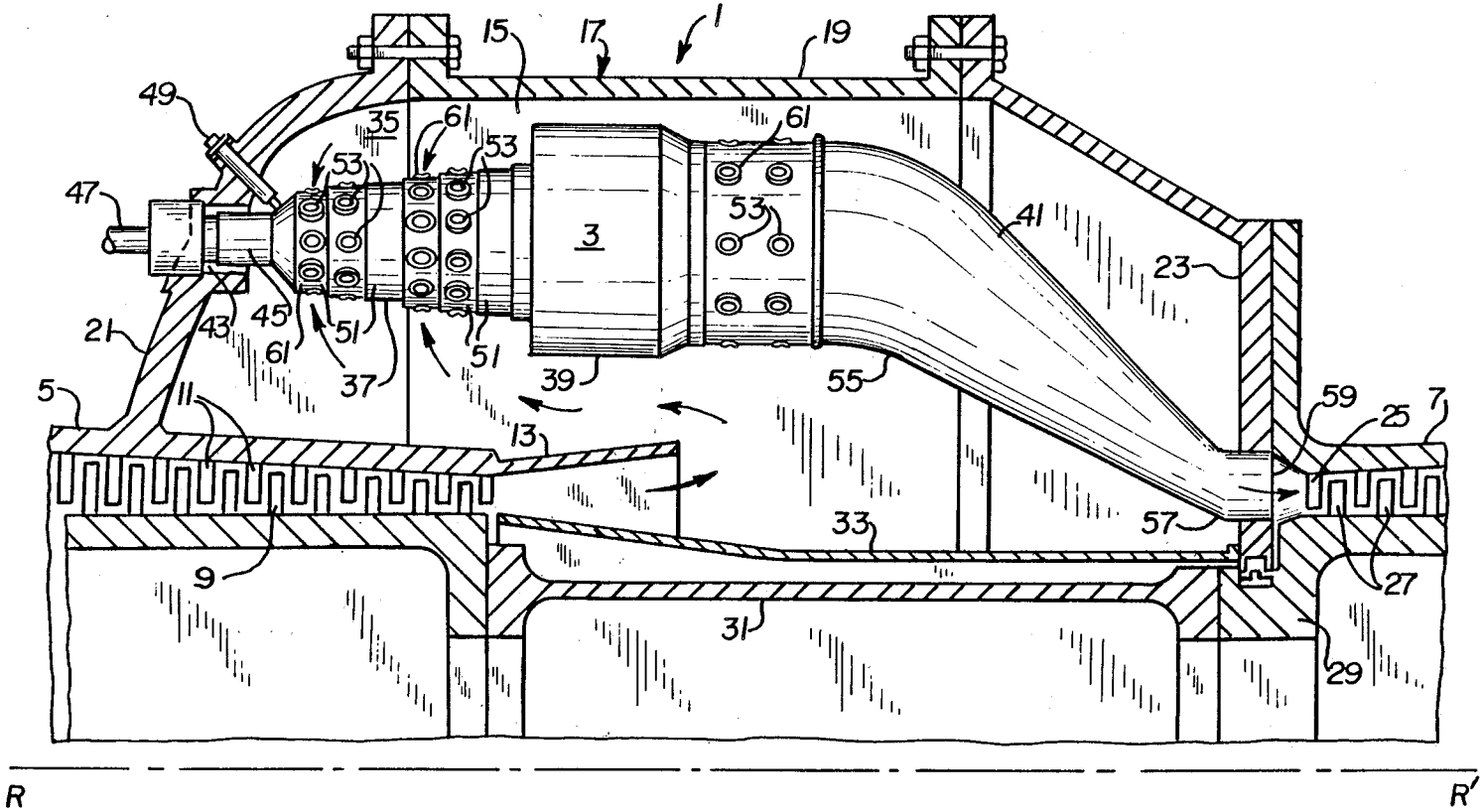
FIG. 1 is an axial sectional view of a portion of the upper half of a gas turbine power plant provided with the combustion chamber constructed in accordance with the present invention.
Figure 2:
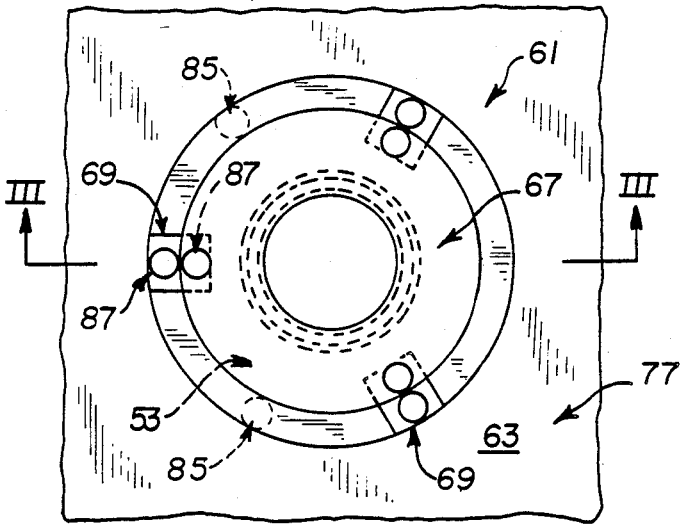
FIG. 2 is a plan view of a section of the embodiment of FIG. 1 showing an air scoop extending through an aperture in the wall of the combustion chamber.
Figure 3:
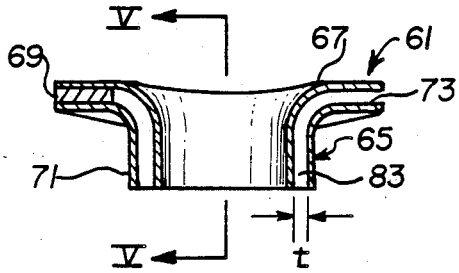
FIG. 3 is a view taken along lines III—III of FIG. 2.
Figure 4:
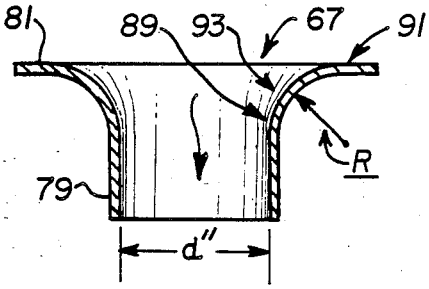
FIG. 4 is an elevational sectional view of an inner tubular member of the air scoop illustrated in FIG. 3.
Figure 5:
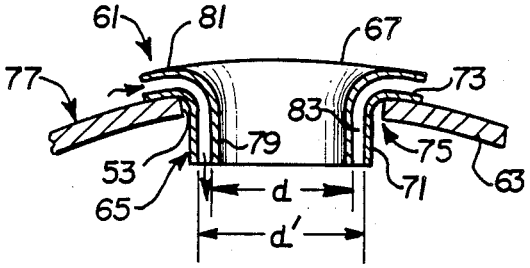
FIG. 5 is a view taken along lines V—V of FIG. 3.

Referring now to FIG. 1, there is illustrated a portion of a gas turbine power plant 1 having a combustion apparatus designated as 3. The combustion apparatus may, however, be used with any type of gas turbine power plant. The power plant 1 includes an axial flow air compressor 5, for directing air to the combustion apparatus 3, and a gas turbine 7 connected to the combustion apparatus 3 which receives hot combustion products from the combustion apparatus for motivating the power plant.

Only the upper half of the power plant and combustion apparatus have been illustrated, since the lower half may be substantially identical and symmetrical about the centerline or axis of rotation RR' of the power plant.

The air compressor 5 includes, as is well known in the art, a multi-stage bladed rotor structure 9 cooperatively associated with a stator structure having an equal number of multi-stage stationary blades 11 for compressing the air directed therethrough to a suitable pressure value for combustion in the combustion apparatus 3. The outlet of the compressor 5 is directed through an annular diffusion member 13 forming an intake for a plenum chamber 15, partially defined by a housing structure 17. The housing 17 includes a shell member or combustion chamber wall 19 of circular cross-section, and as shown of cylindrical shape, parallel with the axis of rotation RR' of the power plant 1, a forward dome-shaped wall member 21 connected to the external casing of the compressor 5 and a rearward annular wall member 23 connected to the outer casing of the turbine 7.

The turbine 7, as mentioned above, is of the axial flow type and includes a plurality of expansion stages formed by a plurality of rows of stationary blades 25 cooperatively associated with an equal plurality of rotating blades 27 mounted on the turbine rotor 29. The turbine rotor 29 is drivingly connected to the compressor rotor 9 by a tubular connecting shaft member 31, and a tubular liner or fairing member 33 is suitably supported in encompassing stationary relation with the connecting shaft portion 31 to provide a smooth air flow surface for the air entering the plenum chamber 15 from the compressor diffuser 13.

Disposed within the housing or combustion chamber 17 are a plurality of tubular elongated combustion chambers or combustors 35 of the telescopic step-liner type. The combustion chambers 35 are disposed in an annular mutually spaced array concentric with the centerline of the power plant and are equally spaced from each other within the combustion chamber wall 19. The combustion chambers 35 are arranged in such a manner that their axes are substantially parallel to the outer casing 17 and with the centerline RR' of the power plant 1. It is pointed out that this invention is applicable to other types of combustors such as the single annular basket type or the can-annular type having composite features of the canister and annular types.

Since the combustors 35 may be substantially identical, only one will be described. As shown in FIG. 1, each combustor 35 is comprised of three sections: an upstream primary section 37, an intermediate secondary section 39 and a downstream transition section 41.

The forward wall 21 of the combustion apparatus 3 is provided with a central opening 43 through which a fuel injector 45 extends. The fuel injector 45 is supplied with fuel by a suitable conduit 47 connected to any suitable fuel supply (not shown) and may be of the well known atomizing type formed in a manner to provide a substantially conical spray of fuel within the primary portion 37 of the combustion chamber 35. An electrical igniter 49 is provided for igniting the fuel and air mixture in the combustor 35.

In the primary portion 37 of the combustor 35, there are a plurality of liner portions 51 of circular cross section and in the example shown, the liner portions are cylindrical. The primary portion 37 is of stepped liner construction, each of the liner portions 51 having a circular section of greater circumference or diameter than the preceding portions from the upstream to the downstream end of the combustor to permit telescopic insertion of the portions. Some portions 51 have an annular array of apertures 53 for admitting primary or secondary air from within the plenum chamber 15 into the primary portion 37 of the combustor to support combustion of the fuel injected therein by the fuel injector 45. The combustor 35 further includes the intermediate portion 39 which is provided with additional arrays of annular rows of apertures 53 for admitting secondary air from the plenum chamber 15 into the combustor 35 during operation, to cool the hot gaseous products and make it adaptable to the turbine blades 25 and 27. The transition portion 41 is provided with a forward portion 55 of cylindrical shape disposed in encompassing and slightly overlapping relationship with the intermediate portion 39. The transition portion 41 is also provided with a rearward tubular portion 57 that purposely changes in contour from a circular cross section at the juncture with the cylindrical portion 55 to an arcuate cross section at its outlet end portion 59. The arcuate extent of the outlet 59 is such that jointly with the outlets of the other combustors 35 not shown, a complete annulus is provided for admitting the hot products of combustion from each of the combustors 35 to the blades 25 and 27 of the turbine 7, thereby to provide full peripheral admission of the motivating gases into the turbine 7.

In accordance with the present invention, an air scoop 61 is provided in at least one aperture 53, which air scoop comprises a pair of concentric spaced tubular members having a specific configuration. Referring now to FIGS. 2 to 5, an air scoop 61 is positioned in an aperture 53 in the wall 63 of the combustor 35, the scoop comprising an outer tubular member 65, inner tubular member 67 and spacer members 69. The outer tubular member 65 has an inner cylindrical portion 71 and a first outwardly extending flange portion 73 at the outer end 75 thereof, which flanged portion 73 is secured, such as by welding to the outer surface 77 of the wall 63 of the combustor 35.

Coaxially disposed within, and spaced from, the outer tubular member 65 is inner tubular member 67. Inner tubular member 67 is comprised of an inner cylindrical portion 79 which has an outer diameter d, less than the inner diameter d' of cylindrical portion 71, and a second outer flanged portion 81. The spacer members 69 are provided between the first flange 73 of the outer tubular member 65 and the second flange 81 of the inner tubular member 67. The arrangement of the inner tubular member 67 in spaced relationship and coaxially within the outer tubular member 65 provides an annular air flow passage 83 therebetween. The spacer members 69, between the first flange 73 of the outer tubular member and the second flange 81 of the inner tubular member 67 allow cooling air to flow between the flanges 73 and 81 and then through the annular air flow passage 83, as indicated by the arrows in Figure 5.

Welds, such as spot welds 85, are used to secure the flange 73 of the outer tubular member 65 to the outer surface 77 of the wall 63 of the combustor 35, while further welds, such as spot welds 87 are provided to secure the spacer members 69 to each of the flange 73 of the outer tubular member 65 and the flange 81 of the inner tubular member 67 which secures the spacer members in position and aligns the inner and outer tubular members 65, 67 in coaxial relationship to provide the annular air flow passage 83.

The inner tubular member 67 is preferably constructed and arranged such that improved flow of air therethrough is provided. As illustrated, with particular reference to FIG. 4, the inner tubular member 67 has a large radius at the inlet to improve flow streamlines therein. The inner tubular member 67 has an inner diameter d", and the radius R between the initial vertical section 89 of the cylindrical portion 79 and the initial horizontal section 91 of the second outer flanged portion 81, comprising a radially outwardly extending arcuate section 93, has a radius of a valve of at least ⅓ of the inner diameter d" of the inner tubular member 67. By use of such an arrangement, experimental studies show the flow coefficient through the inner tubular member 67 to be greater than 0.90 at the pressure drops encountered in existing combustion turbines wherein pressure drops on the order of 4 to 6 pounds per square inch guage (2812–4218 $Kg/m^2$).

As an example of the relative dimensions of the tubular members of the air scoop, a preferred air scoop would have an inner diameter d" of about 2.54 to 3.5 cm (1 to 1.375 inch), with 2.4 cm being preferred. The annular air flow passage 83, between the outer tubular member 65 and the inner tubular member 67, is of a width of about 0.19 to 0.32 cm (0.075 to 0.125 inch), preferably about 0.254 cm (0.10 inch). The radius R, of a value of d'/3 would thus be about 0.85 to 1.16 cm (0.33 to 0.46 inch) or more. An inspection of a prototype configuration after 300 hours of operation was encouraging. There was no discoloration or loss of material on the terminus of the tubular members, while the annular air flow passage and that of the tubular members were free of deposits indicating uniform, non-separating air flow.

The present invention provides an air scoop constructed and arranged in a combustion chamber of a gas turbine that will withstand the high temperatures in the primary zone of a combustor apparatus and, being provided with a large radius on an inner tubular member, improves flow control into the combustor apparatus.

What is claimed is:

1. A gas turbine combustion chamber including means for admission of fuel to the upstream end thereof and discharge of hot gases from the downstream end thereof, and a combustion chamber wall, having an outer surface, with apertures therethrough, and air scoops provided through said apertures to direct air into the combustion chamber, the air scoops comprising:

an outer tubular member having an inner cylindrical portion and a first outer flanged portion, the flanged portion secured to the combustion chamber wall at said outer surface thereof;

an inner tubular member, having an inner cylindrical portion of an outer diameter less than the inner diameter of said inner cylindrical portion of said outer tubular member and coaxially positioned therein in spaced relationship to provide an annular air flow passage therebetween, the inner tubular member having a second outer flanged portion overlying the first outer flanged portion of said outer tubular member; and at least one spacer member disposed between said first flanged portion and said second flanged portion, and secured thereto, adapted to allow cooling air flow between said flanges and through said annular air flow passage into said combustion chamber.

2. A gas turbine combustion chamber as defined in claim 1 wherein said inner cylindrical portion of the inner tubular member has an inner diameter, and a radially outwardly extending arcuate section between said inner cylindrical portion and said second outer flange, which radially outwardly extending arcuate section has a radius equal to at least about one-third of said inner diameter.

3. A gas turbine combustion chamber as defined in claim 2 wherein said first outer flanged portion of the outer tubular member is welded to the outer surface of said combustion chamber wall and said spacer member is welded to both said first outer flanged portion and said second outer flanged portion.

4. A gas turbine combustion chamber as defined in claim 3 wherein said welds are spot welds.

5. A gas turbine combustion chamber as defined in claim 2 wherein said inner diameter is between about 2.54 to 3.5 cm and said radius is between about 0.85 to 1.16 cm.

6. A gas turbine combustion chamber including means for admission of fuel to the upstream end thereof and discharge of hot gases from the downstream end thereof, and a combustion chamber wall, having an outer surface, with apertures therethrough, and air scoops provided through said apertures to direct air into the combustion chamber, the air scoops comprising:

an outer tubular member having an inner cylindrical portion and a first outer flanged portion, the flanged portion secured to the combustion chamber wall at said outer surface thereof;

an inner tubular member, having an inner cylindrical portion of an outer diameter less than the inner diameter of said inner cylindrical portion of said outer tubular member and coaxially positioned therein in spaced relationship to provide an annular air flow passage therebetween, the inner tubular member having a second outer flanged portion overlying the first outer flanged portion of said outer tubular member, with the inner cylindrical portion of the inner tubular member having an inner diameter, and a radially outwardly extending arcuate section between said inner cylindrical portion and said second outer flange, which radially outwardly extending arcuate section has a radius equal to at least about one-third of said inner diameter; and at least one spacer member disposed between said first flanged portion and said second flanged portion, and secured thereto, adapted to allow cooling air flow between said flanges and through said annular air flow passage into said combustion chamber.

7. A gas turbine combustion chamber as defined in claim 2 wherein said inner diameter is between about 2.54 to 3.5 cm and said radius is between about 0.85 to 1.16 cm.

* * * * *